US006042696A

United States Patent [19]

Roy et al.

[11] Patent Number: 6,042,696

[45] Date of Patent: Mar. 28, 2000

[54] HORIZONTAL MOVING AND STIRRED BED REACTOR

[75] Inventors: Christian Roy, Sillery; Daniel Blanchette, Breakeyville; Bruno de Caumia, Stoneham, all of Canada

[73] Assignee: Pyrovac Technologies Inc., Montreal, Canada

[21] Appl. No.: 08/811,172

[22] Filed: Mar. 4, 1997

[51] Int. Cl.[7] ..... C10B 1/00; C10B 1/06

[52] U.S. Cl. ..... 202/117; 202/117; 202/133; 202/265

[58] Field of Search ..... 34/180, 181, 68; 432/140, 144, 130; 110/269, 285; 202/117, 265, 133

[56] References Cited

U.S. PATENT DOCUMENTS

| | | | |
|---|---|---|---|
| 1,788,351 | 1/1931 | Stokes et al. . | |
| 3,190,434 | 6/1965 | Dardaine . | |
| 3,697,056 | 10/1972 | Prins et al. | 263/8 |
| 3,744,145 | 7/1973 | Maxwell et al | 34/68 |
| 4,202,483 | 5/1980 | Sillars | 228/43 |
| 4,740,270 | 4/1988 | Roy . | |
| 4,997,081 | 3/1991 | Sutin . | |
| 5,451,297 | 9/1995 | Roy . | |
| 6,775,100 | 7/1901 | Hall . | |

FOREIGN PATENT DOCUMENTS

| | | |
|---|---|---|
| 693038 | 11/1930 | France . |
| 344301 | 3/1931 | United Kingdom . |
| 505151 | 5/1939 | United Kingdom . |
| 508782 | 7/1939 | United Kingdom . |
| 586671 | 3/1947 | United Kingdom . |

*Primary Examiner*—Hien Tran
*Assistant Examiner*—James Kennedy
*Attorney, Agent, or Firm*—Foley & Lardner

[57] ABSTRACT

A horizontal moving bed reactor for heat treating particulate material comprises a housing having an inlet for admitting therein the particulate material to be heat treated and an outlet for discharging the heat treated material, at least one tray disposed horizontally inside the housing between the inlet and outlet and having a support surface for supporting a bed of the particulate material, a heating system for heating the bed of particulate material on the support surface, and a conveyor system for moving the bed of particulate material while being heated along a predetermined direction on the support surface. The conveyor system includes a plurality of horizontally spaced-apart rake members extending across the support surface transversely of the predetermined direction and each having a plurality of spaced-apart fingers in sliding contact with the support surface. The rake members are moved to displace with the fingers the particulate material along the predetermined direction, the fingers of any one of the rake members being misaligned with the fingers of any other of the rake members and being spaced relative to one another such that the fingers rake across substantially the entire support surface of the tray and constantly stir the particulate material while displacing same, thereby constantly exposing fresh surfaces of the particulate material to heat and increasing heat transfer in the bed. The horizontal moving bed reactor of the invention can be used not only for pyrolyzing particulate material, but also for drying particulate material and carrying out various reactions requiring heat.

21 Claims, 5 Drawing Sheets

HORIZONTAL MOVING AND STIRRED BED REACTOR

BACKGROUND OF THE INVENTION

The present invention pertains to improvements in the field of pyrolysis. More particularly, the invention relates to an improved horizontal moving bed reactor for pyrolyzing particulate material.

Pyrolysis has become an attractive solution to the growing environmental problems caused by the generational and worldwide accumulation of scrap tires and automobile shredder residues. Applicant has already proposed in U.S. Pat. No. 4,740,270 to treat scrap tires by vacuum pyrolysis. Used rubber tires in the form of cuttings are decomposed under vacuum at about 360°–415° C. to useful products such as carbon black, hydrocarbon oils and gas. In U.S. Pat. No. 5,451,297, Applicant has proposed to also treat automobile shredder residue by vacuum pyrolysis with a view to recovering commercially valuable products. In either case, the pyrolysis is carried out in a multi-tray reactor having a plurality of spaced-apart heated trays arranged above one another and each receiving a bed of cuttings or shreds charged onto the uppermost tray of the reactor. The bed of particulate material is transported from an upper to a lower tray by means of scraping arms which slowly move the particulate material on each tray towards and into a discharge orifice in the tray so as to fall on a lower tray. The trays are heated at temperatures to provide a vertical temperature gradient between the uppermost and lowermost trays with the lowermost tray being heated at a temperature higher than the uppermost tray.

Applicant has observed that the layer of material in contact with each heated tray inhibits efficient heat transfer from the heated tray to the center of the bed. Where the particulate material subjected to pyrolysis is a carbon-based material such as rubber tire, the particles of rubber in contact with the heated tray become coated with a layer of carbonaceous material and such a carbon layer acts as a heat insulator to further inhibit heat transfer. The same problems occur when the material is exposed to overhead heat radiation.

SUMMARY OF THE INVENTION

It is therefore an object of the present invention to overcome the above drawbacks and to increase heat transfer in a horizontal moving bed reactor.

In accordance with the present invention, there is provided a horizontal moving bed reactor for heat treating particulate material, comprising a housing having inlet means for admitting therein the particulate material to be heat treated and outlet means for discharging the heat treated material, at least one tray disposed horizontally inside the housing between the inlet and outlet means and having a support surface for supporting a bed of the particulate material, heating means for heating the bed of particulate material on the support surface, and a conveyor system for moving the bed of particulate material while being heated along a predetermined direction on the support surface. The conveyor system includes a plurality of horizontally spaced-apart rake members extending across the support surface transversely of the predetermined direction and each having a plurality of spaced-apart fingers in sliding contact with the support surface, and means for moving the rake members to displace with the fingers the particulate material along the predetermined direction. The fingers of any one of the rake members are misaligned with the fingers of any other one of the rake members and are spaced relative to one another such that the fingers rake across substantially the entire support surface of the tray and constantly stir the particulate material while displacing same, thereby constantly exposing fresh surfaces of the particulate material to heat and increasing heat transfer in the bed.

Applicant has found quite unexpectedly that by utilizing a plurality of rake members as defined above to move a bed of particulate material while being heated on a support surface, the particulate material is constantly stirred during displacement so that fresh surfaces of the particulate material are constantly exposed to the heat. Constant agitation of the particulate material also provides a much higher interparticle heat transfer in the bed. Thus, heat transfer in the bed of particulate material is increased. The provision of fingers in sliding contact with the support surface ensures that the layer of particulate material in contact with the tray is also stirred.

The term "particulate material" as used herein refers to solid material in fragmented form. Thus, such a term encompasses not only particles, but also granules, shreds and cuttings.

According to a preferred embodiment of the invention, the at least one tray is in the form of an open-ended trough having a widened U-shaped cross-section and including a bottom wall and a pair of opposed sidewalls extending upwardly from the bottom wall, the bottom wall having a top surface defining the aforesaid support surface. Preferably, there are two such troughs arranged one above the other, discharge means being provided for discharging the particulate material from an upper trough into a lower trough.

According to another preferred embodiment, the conveyor system is adapted to move the bed of particulate material on the bottom wall of the upper trough along one direction and to move the bed of particulate material on the bottom wall of the lower trough along an opposite direction. Preferably, the means for moving the rake members comprise a pair of endless chains each having an upper straight run course and a lower straight run course and positioned such that the upper straight run course of one chain extends over and adjacent one sidewall of the upper trough and the lower straight run course of the one chain extends over and adjacent one sidewall of the lower trough, and that the upper straight run course of the other chain extends over and adjacent the other sidewall of the upper trough and the lower straight run course of the other chain extends over and adjacent the other sidewall of the lower trough, and drive means for driving said chains. In such an embodiment, each rake member advantageously includes an elongated finger-carrying member secured at the ends thereof to the chains, the aforesaid fingers being extending outwardly from opposite sides of the finger-carrying member such that the fingers on one of the sides of the bar contact the bottom wall of one of the troughs when the rake member is moved along the one trough and the fingers on the other of aforesaid sides of the finger-carrying member contact the bottom wall of the other trough when the rake member is moved along the other trough.

In a particularly preferred embodiment of the invention, each finger slidably extends through a respective opening defined through the finger-carrying member of each rake member for movement along the longitudinal axis of the finger such that the finger projects from the aforesaid opposite sides of the finger-carrying member. Each finger is provided with stop means retaining the finger on the finger-carrying member of each rake member while allowing limited longitudinal movement of the finger. Thus, whereby when each rake member is moved by the chains from the one trough to the other trough the fingers of the rake member turn upside down and drop down to contact the bottom wall of the other trough.

According to yet another preferred embodiment, the heating means are adapted to heat the bottom wall of each the trough such that heat is transferred from the heated bottom wall to the bed of particulate material thereon. Such heating means preferably comprise a first series of tubular members extending underneath the bottom wall of the lower trough and contacting same, a second series of tubular members extending underneath the bottom wall of the upper trough and contacting same, conduit means interconnecting the first and second series of tubular members, and means for circulating a heated fluid through the tubular members of the first and second series.

The horizontal moving bed reactor of the invention can be used not only for pyrolyzing particulate material, but also for drying and mixing particulate material and carrying out various reactions requiring heat.

BRIEF DESCRIPTION OF THE DRAWINGS

Further features and advantages of the invention will become more readily apparent from the following description of a preferred embodiment thereof as illustrated by way of example in the accompanying drawings, in which.

DESCRIPTION OF PREFERRED EMBODIMENTS

Figure 1:
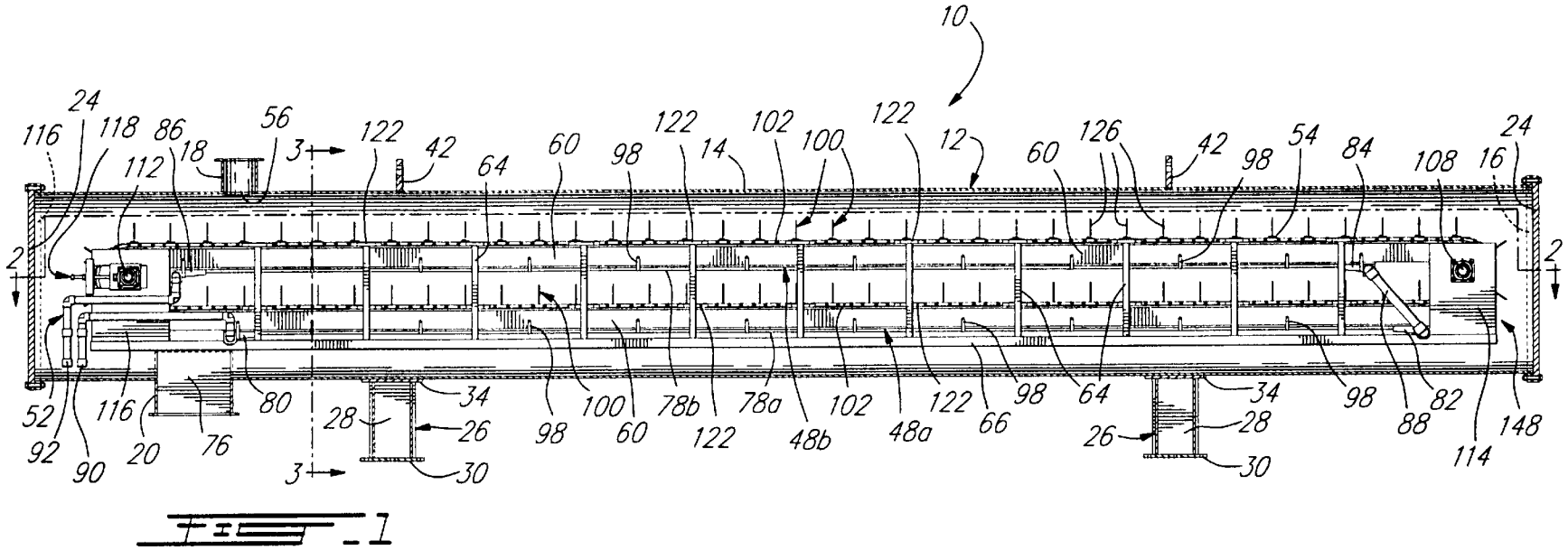
FIG. 1 is a vertical longitudinal sectional view of a horizontal moving bed reactor according to a preferred embodiment of the invention.
Figure 2:
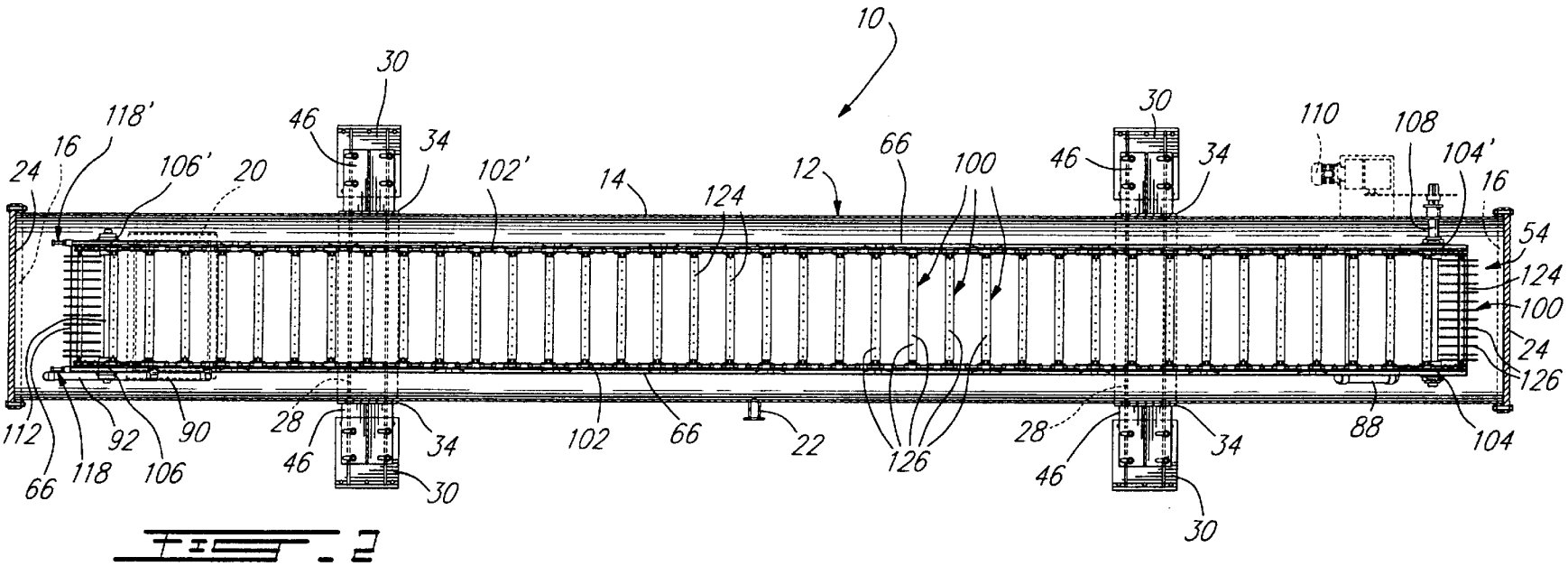
FIG. 2 is a horizontal longitudinal sectional view taken along line 2—2 of FIG. 1.
Figure 3:
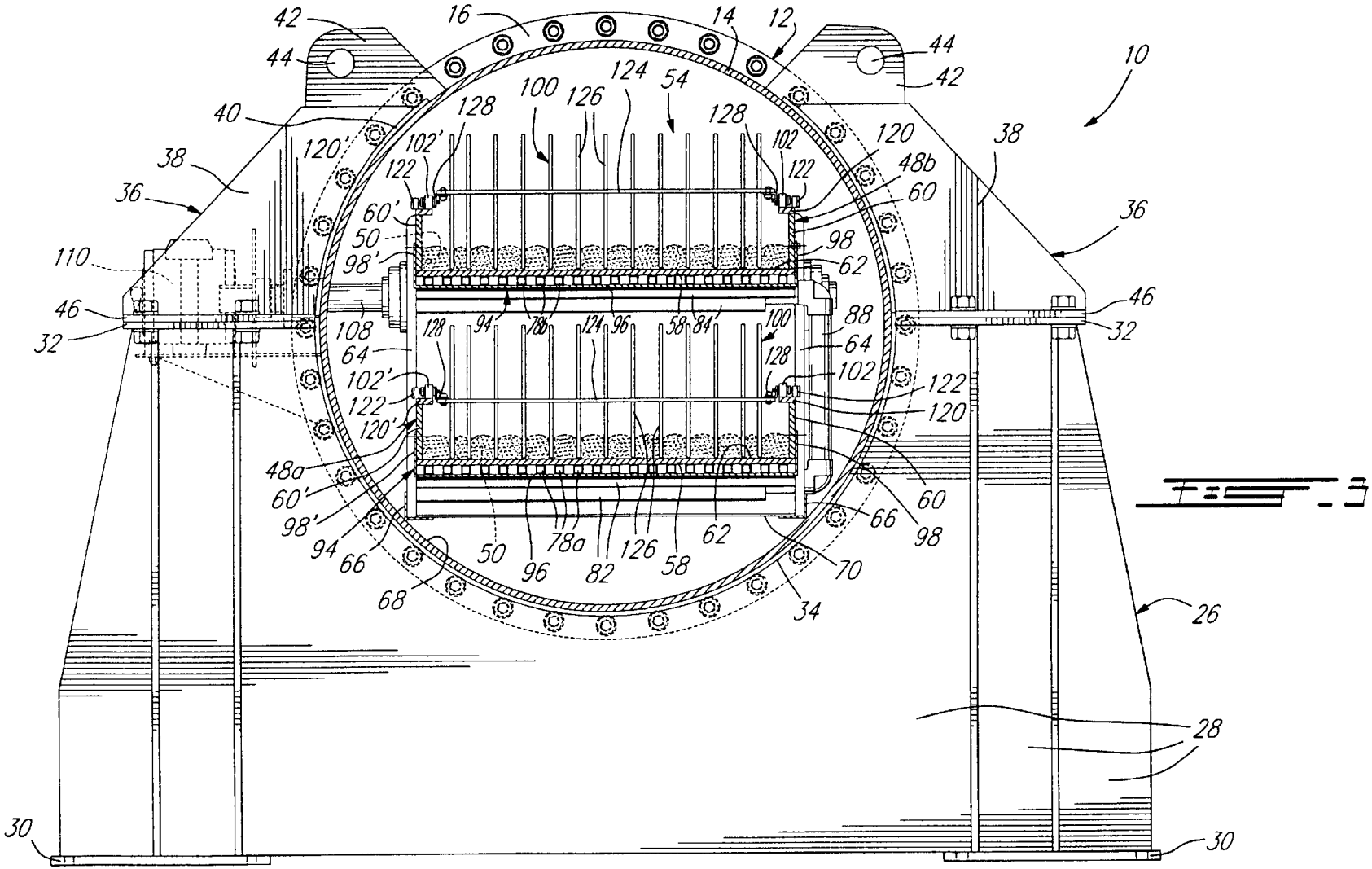
FIG. 3 is a cross-sectional view taken along line 3—3 of FIG. 1.

Referring to FIGS. 1, 2 and 3, there is illustrated a horizontal moving bed reactor which is generally designated by reference numeral 10, for heat treating particulate material. The reactor 10 comprises an elongated, open-ended housing 12 having a cylindrical wall 14 of circular cross-section with circumferential flanges 16, a feed inlet 18 for receiving the particulate material to be heat treated, a first discharge outlet 20 for discharging the heat treated material and a second discharge outlet 22 for evacuating gaseous products formed during the heat treatment. The discharge outlet 22 is connected to a vacuum pump via a series of condenser units when the particulate material is subjected to vacuum pyrolysis in the reactor. The ends of the housing 12 are closed with removable covers 24 which are releasably secured to the flanges 16 by means of bolts and nuts.

Two cradle units 26 are provided for supporting the housing 12. Each cradle unit 26 comprises a base 28 with two feet 30, a pair of abutment plates 32 and a semi-circular support member 34 on which the housing 12 rests, as best shown in FIG. 3. The support member 34 is welded to the base 28. As shown in FIG. 3, a pair of lift arrangements 36 is provided on opposite sides of the housing 12 above each cradle unit 26 in order to enable the housing 12 to be lifted for relocation of the reactor 10. Each lift arrangement 36 comprises a plate 38 in the form of a wing welded to an arcuate member 40 which in turn is welded to the wall 14 of the housing 12, the plate 38 being provided with an apertured ear 42 for receiving the hook of a crane through the aperture 44. Each lift arrangement 36 further includes an abutment plate 46 welded to the plate 38 and abutting a respective plate 32 of the cradle unit 26. The plates 46 of one pair of lift arrangement 36 are releasably secured to the plates 32 of the underlying cradle unit 26 by means of tightened bolts and nuts, whereas the plates 46 of the other pair of lift arrangement 36 and plates 32 are loosely secured to one another by means of untightened bolts and nuts, the bolts extending through slots formed in the plates 32, 46, thereby permitting the plates 46 of the other pair of lift arrangement 36 to move on plates 32 during thermal expansion of the wall 14.

Figure 4:
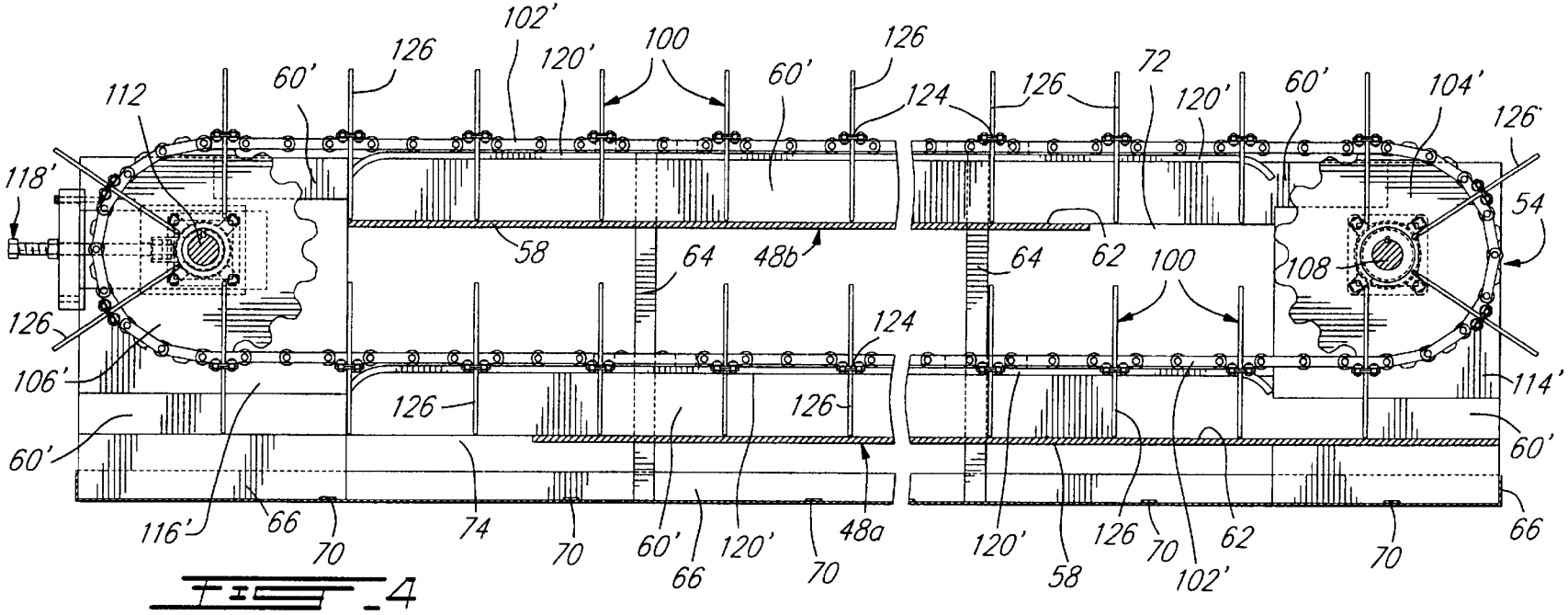
FIG. 4 is a fragmented sectional view illustrating the conveyor system utilized in the reactor shown in FIG. 1.

The reactor 10 includes two open-ended troughs 48*a*, 48*b* arranged one above the other and each defining a tray for supporting a bed 50 of particulate material (shown in broken line in FIG. 3), a heating system 52 for heating the bed of particulate material in each trough and a conveyor system 54 for moving each bed along a respective trough. The feed inlet 18 is disposed relative to the upper trough 48*b* such that particulate material charged through the feed orifice 56 falls into the upper trough 48*b* adjacent one end thereof. Each trough 48*a*, 48*b* has a widened U-shaped cross-section and comprises a bottom wall 58 and a pair of opposed sidewalls 60, 60' extending upwardly from the bottom wall 58, the top surface 62 of the bottom wall 58 defining a supporting surface for supporting the bed 50 of particulate material. The upper trough 48*b* is supported above the lower trough 48*a* by a plurality of spaced-apart upwardly extending side arms 64 welded to the sidewalls 60, 60' of the lower and upper troughs 48*a*, 48*b*, the side arms 64 being welded at their lower end to a frame member 66 of L-shaped cross-section which defines a rectangular frame and rests on the inner surface 68 of the cylindrical wall 14. A plurality of spaced-apart transverse brace members 70 extend between opposite sides of the frame member 66. As shown in FIG. 4, an opening 72 is defined in the bottom wall 58 of the upper trough 48*b* for discharging particulate material therefrom into the lower trough 48*a* at one end thereof. An opening 74 is also defined in the bottom wall 58 of the lower trough 48*a* at the other end thereof for discharging the particulate material from the lower trough 48*a* into the discharged orifice 76 (shown in FIG. 1) formed in the cylindrical wall 14.

The heating system 52 comprises a first series of spaced-apart parallel tubular members 78*a* extending underneath the bottom wall 58 of the lower trough 48*a* and contacting same, and a second series of spaced-apart parallel tubular members 78*b* extending underneath the bottom wall 58 of the upper trough 48*b* and contacting same, as best shown in FIG. 3. The extremities of tubular members 78*a* are connected to inlet and outlet manifolds 80 and 82, whereas the extremities of tubular members 78*b* are connected to inlet and outlet manifolds 84 and 86. A conduit 88 interconnects the outlet manifold 82 and inlet manifold 84. Inlet and outlet conduits 90 and 92 are connected to the inlet manifolds 80 and outlet manifold 86, respectively, for circulating a heated fluid through the tubular members 78*a* and 78*b* so as to heat the bottom wall 58 of each trough 48*a*, 48*b* and thereby transfer heat from the heated bottom wall to the bed 50 of particulate material thereon. The direct contact of the particulate material with the heating surface 52 allows both conduction and radiation heat transfer to be significant, thereby greatly increasing the contact heat transfer coefficient on the heating surface which may be as high as 200–1000 $w/m^{2}\cdot°$ C., depending on the size of the particulate material. The tubular members 78*a*, 78*b* are held in contact with the bottom wall 58 of troughs 48*a*, 48*b* by a plurality of spaced-apart transverse retaining members 94 having a widened U-shape. As shown in FIG. 3, each retaining member 94 has a bight portion 96 holding the tubular members in contact with the bottom wall 58 and a pair of arm portions 98 and 98' fixed to the sidewalls 60 and 60', respectively, of troughs 48*a*, 48*b*. Thus, when a heated fluid is circulated through tubular members 78*b*, the heated fluid provides overhead heat radiation for heating the bed 50 of particulate material in the lower trough 48*a*.

Figure 5:
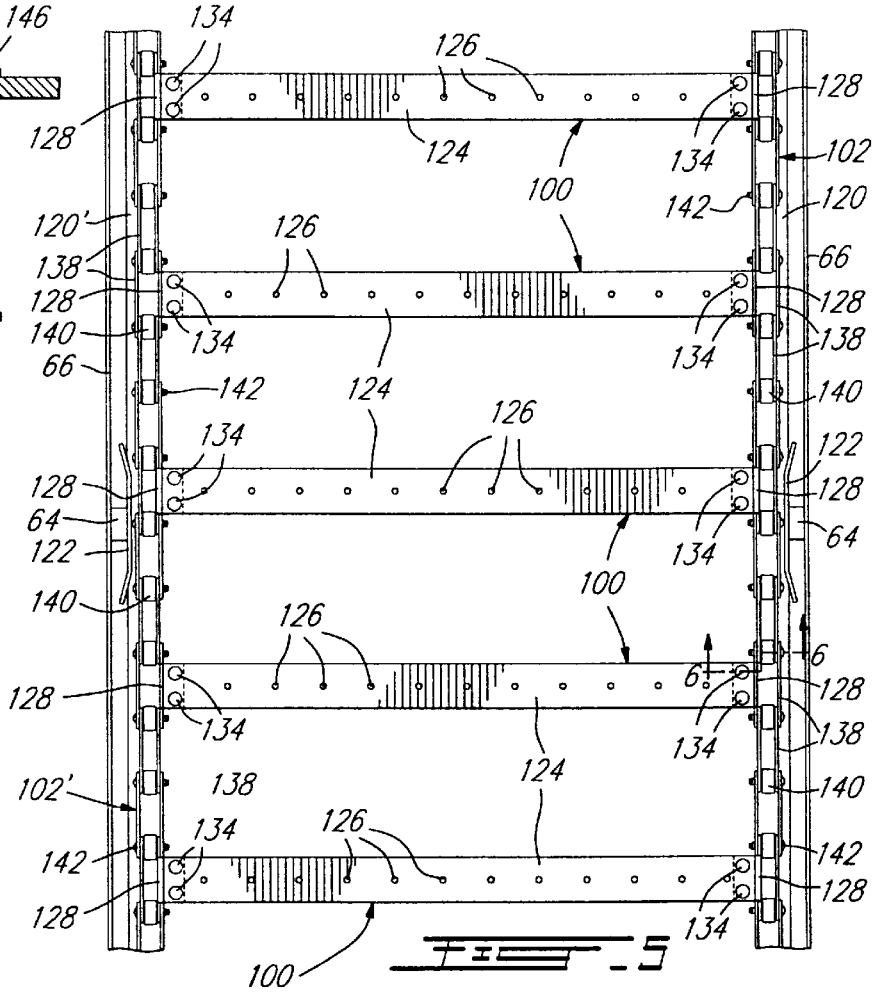
FIG. 5 is a fragmented top view of the conveyor system.

As shown in FIGS. 2, 3 and 4, the conveyor system 54 comprises a plurality of horizontally spaced-apart rake members 100 extending laterally across the bottom wall 58 of each trough 48*a*, 48*b* and secured to a pair of endless chains 102, 102' in meshing engagement with sprockets 104, 106 and 104', 106', respectively. Sprockets 104 and 104' are mounted on a drive shaft 108 which is coupled to a motor 110. Sprockets 106 and 106' are mounted on a driven shaft 112. The drive shaft 108 is supported by a pair of opposed end plates 114 and 114' which are detachably connected to the sidewalls 60 and 60', respectively, of troughs 48*a*, 48*b* as well as to the frame member 66; plate 114 is shown in FIG. 1. Similarly, the driven shaft 112 is supported by a pair of opposed end plates 116 and 116' which are detachably connected to the sidewalls 60 and 60', respectively, of troughs 48*a*, 48*b* as well as to the frame member 66; plate 116 is shown in FIG. 1. Chain tensioning arrangement 118 and 118' are provided for adjusting the tension of chains 102 and 102'. Rails 120 and 120' extending along the upper edges of sidewalls 60 and 60', respectively, of troughs 48*a*, 48*b* support the chains 102 and 102' along their lower and upper straight run courses. A plurality of guide members 122 welded to rails 120, 120' guide and maintain the chains 102 and 102' on the rails 120 and 120', respectively, as best shown in FIG. 5. Referring to FIG. 4, the conveyor system 54 is adapted to move the bed of particulate material along the upper trough 48*b* from left to right and to move the bed of particulate material along the lower trough 48*a* from right to left.

Figure 6:
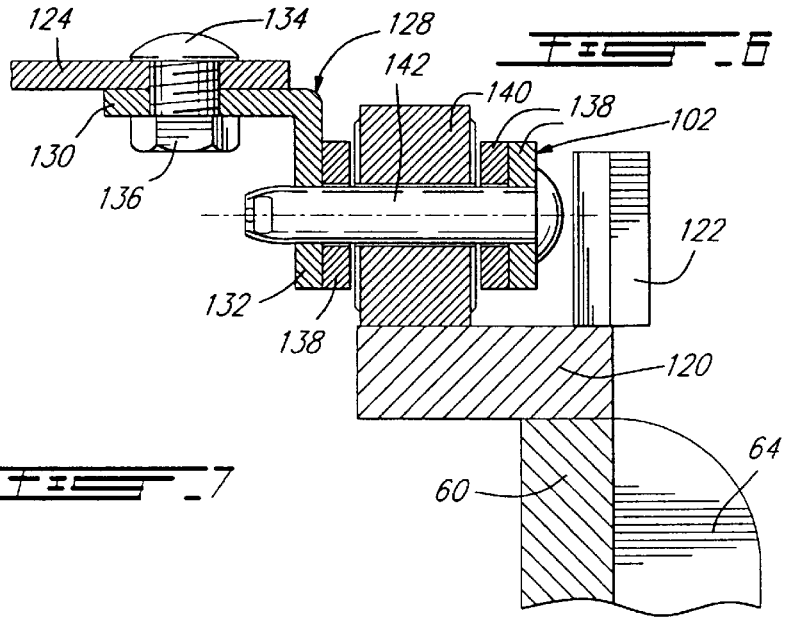
FIG. 6 is a sectional view taken along line 6—6 of FIG. 5.
Figure 7:
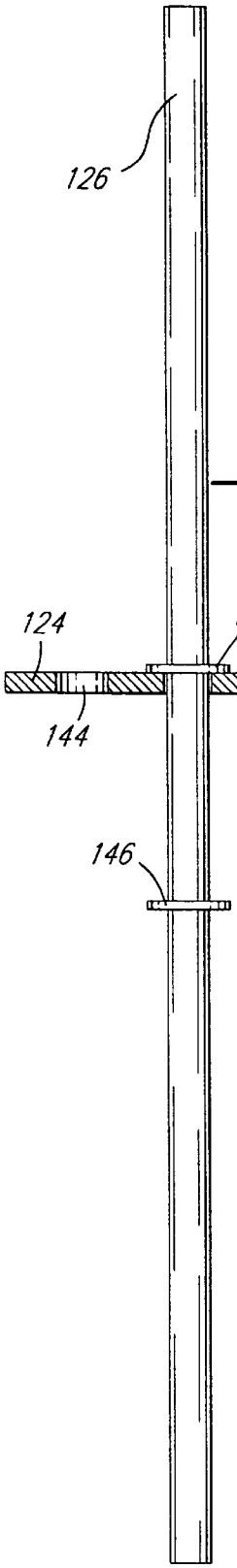
FIG. 7 is a fragmented sectional view of a rake member showing one finger thereof.

Each rake member 100 comprises a transverse bar 124 secured at the ends thereof to the chains 102, 102' and a plurality of spaced-apart elongated fingers 126 of circular cross-section are mounted on the bar. As shown in FIGS. 5 and 6, the bar 124 is secured to the chains 102, 102' by a pair of L-shaped brackets 128 each having apertured arms 130, 132. The bar 124 is releasably secured to the arm 130 by bolts 134 and welded nuts 136. The arm 132 replaces one of the chain links 138 interconnecting the chain rollers 140 and is fixed to the chain pins 142. Each finger 126 slidably extends through a respective opening 144 defined through the bar 124 for movement along the longitudinal axis of the finger such that the finger 126 projects from opposite sides of the bar 124. Each finger 126 is provided with two stop members 146 disposed on either side of the bar 124 for retaining the fingers on the bar while allowing limited longitudinal movement of the fingers. Thus, when each rake member 100 is moved by the chains 102, 102' from one of the troughs 48*a*, 48*b* to the other trough, the fingers 126 of the rake member 100 turn upside down and drop down to contact the bottom wall 58 of the other trough. Accordingly, the fingers 126 on one side of the bar 124 contact the bottom wall 58 of the lower trough 48*a* when the rake member 100 is moved along the trough 48*a* and the fingers 126 on the other side of the bar 124 contact the bottom wall 58 of the upper trough 48*b* when the rake member 100 is moved along the trough 48*b*. As shown in FIGS. 2 and 5, the fingers 126 of any one of the rake members 100 are misaligned with the fingers 126 of any other one of the rake members 100 and are spaced relative to one another such that the fingers 126 rake across substantially the entire top surface 62 of the bottom wall 58 of each trough 48*a*, 48*b* and constantly stir the particulate material while displacing same. As a result, fresh surfaces of the particulate material are constantly exposed to the heat so that heat transfer from the heated bottom wall 58 to the bed 50 of particulate material thereon is increased.

As it is apparent from FIG. 1, the lower and upper troughs 48*a*, 48*b* together with the heating system 52 and conveyor system 54 define a modular unit 148 which can be withdrawn from the housing 12 for servicing, after having disconnected the inlet and outlet conduits 90, 92 and drive shaft 108. Several units 148 can also be arranged above one another inside a larger housing.

We claim:

1. A horizontal moving bed reactor for heat treating particulate material comprising:

a housing having inlet means for admitting therein the particulate material to be heat treated and outlet means for discharging the heat treated material;

at least one tray disposed horizontally inside said housing between said inlet and outlet means and having a support surface for supporting a bed of said particulate material;

heating means for heating said bed of particulate material on said support surface; and a conveyor system for moving said bed of particulate material while being heated along a predetermined direction on said support surface, said conveyor system including a plurality of horizontally spaced-apart rake members extending across said support surface transversely of said predetermined direction and each having a plurality of spaced-apart fingers in sliding contact with said support surface, and means for moving said rake members to displace with said fingers said particulate material along said predetermined direction, the fingers of any one of said rake members being misaligned with the fingers of any other of said rake members and being spaced relative to one another such that said fingers rake across substantially the entire support surface of said tray and constantly stir said particulate material while displacing same, thereby constantly exposing fresh surfaces of said particulate material to heat and increasing heat transfer in said bed.

2. A reactor as claimed in claim 1, wherein said at least one tray is in the form of an open-ended trough having a widened U-shaped cross-section and including a bottom wall and a pair of opposed sidewalls extending upwardly from said bottom wall, said bottom wall having a top surface defining said support surface.

3. A reactor as claimed in claim 2, wherein there are two said troughs arranged one above the other and including first discharge means for discharging the particulate material from an upper trough into a lower trough.

4. A reactor as claimed in claim 3, wherein said first discharge means comprises a first opening formed in the bottom wall of said upper trough at one end thereof.

5. A reactor as claimed in claim 3, wherein said housing has a peripheral wall with a discharge orifice formed therein, said discharge orifice defining said outlet means, and wherein said lower trough includes second discharge means for discharging the particulate material therefrom into said discharge orifice.

6. A reactor as claimed in claim 4, wherein said housing has a peripheral wall with a discharge orifice formed therein, said discharge orifice defining said outlet means, and wherein said lower trough includes second discharge means for discharging the particulate material therefrom into said discharge orifice.

7. A reactor as claimed in claim 6, wherein said lower trough has one end opposite said one end of said upper trough and said second discharge means comprises a second opening formed in the bottom wall of said lower trough at the other end thereof.

8. A reactor as claimed in claim 3, wherein said conveyor system is adapted to move the bed of particulate material on the bottom wall of said upper trough along one direction and to move the bed of particulate material on the bottom wall of said lower trough along an opposite direction.

9. A reactor as claimed in claim 8, wherein said means for moving said rake members comprise a pair of endless chains each having an upper straight run course and a lower straight run course and positioned such that the upper straight run course of one chain extends over and adjacent one sidewall of said upper trough and the lower straight run course of said one chain extends over and adjacent one sidewall of said lower trough, and that the upper straight run course of the other chain extends over and adjacent the other sidewall of said upper trough and the lower straight run course of said other chain extends over and adjacent the other sidewall of said lower trough, and drive means for driving said chains.

10. A reactor as claimed in claim 9, further including chain support means for supporting each chain along the lower and upper straight run courses thereof.

11. A reactor as claimed in claim 10, wherein said chain support means comprise a rail extending along an upper edge of each said sidewall, whereby the rail of each said one sidewall supports said one chain and the rail of each said other sidewall supports said other chain.

12. A reactor as claimed in claim 11, further including chain guide means for guiding and maintaining said chains on said rails.

13. A reactor as claimed in claim 9, wherein each said rake member includes an elongated finger-carrying member secured at the ends thereof to said chains and wherein said fingers extend outwardly from opposite sides of said finger-carrying member such that the fingers on one of said sides of said finger-carrying member contact the bottom wall of one of said troughs when said rake member is moved along said one trough and the fingers on the other of said sides of said finger-carrying member contact the bottom wall of the other trough when said rake member is moved along said other trough.

14. A reactor as claimed in claim 13, wherein each said finger slidably extends through a respective opening defined through the finger-carrying member of each said rake member for movement along a longitudinal axis of said finger such that said finger projects from said opposite sides of said finger-carrying member, and wherein each said finger is provided with stop means retaining said finger on the finger-carrying member of each said rake member while allowing limited longitudinal movement of said finger, whereby when each said rake member is moved by said chains from said one trough to said other trough the fingers of said rake member turn upside down and drop down to contact the bottom wall of said other trough.

15. A reactor as claimed in claim 14, wherein said heating means are adapted to heat the bottom wall of each said trough such that heat is transferred from the heated bottom wall to the bed of particulate material thereon.

16. A reactor as claimed in claim 15, wherein said heating means comprise a first series of tubular members extending underneath the bottom wall of said lower trough and contacting same, a second series of tubular members extending underneath the bottom wall of said upper trough and contacting same, conduit means interconnecting said first and second series of tubular members, and means for circulating a heated fluid through the tubular members of said first and second series.

17. A reactor as claimed in claim 16, wherein said tubular members are held in contact with the bottom wall of each said trough by a plurality of spaced-apart transverse retaining members having a widened U-shape with arm portions fixed to the sidewalls of a respective trough, whereby when said heated fluid is circulated through the tubular members of said second series, said heated fluid provides overhead heat radiation for heating the bed of particulate material in said lower trough.

18. A reactor as claimed in claim 16, further including support means interconnecting said lower and upper troughs for supporting said upper trough above said lower trough.

19. A reactor as claimed in claim 18, wherein said support means comprise a plurality of spaced-apart upwardly extending side arms fixed to the sidewalls of said lower and upper trays.

20. A reactor as claimed in claim 18, wherein said lower and upper troughs together with said endless chains, said first and second series of tubular members and said conduit means define a modular unit.

21. A horizontal moving bed reactor for heat treating particulate material, comprising:

a housing having inlet means for admitting therein the particulate material to be heat treated and outlet means for discharging the heat treated material;

two trays disposed horizontally inside said housing between said inlet and outlet means and each having a respective support surface for supporting a bed of said particulate material, said trays being arranged one above the other to define an upper tray and a lower tray;

discharge means for discharging the particulate material from said upper tray onto said lower tray;

heating means for heating the bed of particulate material on the respective support surface of each said tray; and a conveyor system for moving the bed of particulate material on the support surface of said upper tray along one direction and moving the bed of particulate material on the support surface of said lower tray along an opposite direction, while the bed of particulate material is heated by said heating means, said conveyor system including a plurality of horizontally spaced-apart rake members extending across said respective support surface transversely of said one and opposite directions and each having a plurality of spaced-apart fingers in sliding contact with said respective support surface, and means for moving said rake members to displace with said fingers said particulate material along said one direction and said opposite direction, each rake member comprising an elongated, transversely extending finger-carrying member with said fingers extending outwardly from opposite sides thereof such that the fingers on one of said sides of said finger-carrying member contact the support surface of said upper tray when said rake member is moved along said one direction and the fingers on the other of said sides of said finger-carrying member contact the support surface of said lower tray when said rake member is moved along said opposite direction, the fingers of any one of said rake members being misaligned with the fingers of any other of said rake members and being spaced relative to one another such that said fingers rake across substantially the entire support surface of each said tray and constantly stir said particulate material while displacing same, thereby constantly exposing fresh surfaces of said particulate material to heat and increasing heat transfer in said bed.

* * * * *